US005678938A

United States Patent [19]

Saito et al.

[11] Patent Number: 5,678,938

[45] Date of Patent: Oct. 21, 1997

[54] THERMAL PRINTER

[75] Inventors: Daisuke Saito, Tokyo; Hideaki Matsuda, Miyagi-ken, both of Japan

[73] Assignee: Tohoku Ricoh, Co., Tokyo, Japan

[21] Appl. No.: 519,187

[22] Filed: Aug. 25, 1995

[30] Foreign Application Priority Data

Sep. 9, 1994 [JP] Japan ..... 6-215637

[51] Int. Cl.[6] ..... B41J 2/335

[52] U.S. Cl. ..... 400/120.17; 347/198

[58] Field of Search ..... 400/120.16, 55, 400/356, 120.17; 347/197, 198

[56] References Cited

U.S. PATENT DOCUMENTS

| | | | |
|---|---|---|---|
| 4,750,880 | 6/1988 | Stephenson et al. | 400/120.16 |
| 5,118,208 | 6/1992 | Kitamara | 400/120.16 |
| 5,181,787 | 1/1993 | Hosomi | 400/120.16 |
| 5,414,450 | 5/1995 | Oshino et al. | 400/60 |

FOREIGN PATENT DOCUMENTS

| | | |
|---|---|---|
| 450 748 | 10/1991 | European Pat. Off. . |
| 519495 | 12/1992 | European Pat. Off. . |
| 58-90975 | 5/1983 | Japan . |
| 3-278977 | 12/1991 | Japan . |
| 5-155101 | 6/1993 | Japan . |
| 5-58311 | 8/1993 | Japan . |

*Primary Examiner*—Christopher A. Bennett

*Attorney, Agent, or Firm*—Armstrong, Westerman, Hattori, McLeland & Naughton

[57] ABSTRACT

A thermal printer that prints on a recording sheet by holding the recording sheet between a thermal print head and a platen, driving the thermal print head to generate heat and driving the platen to feed the recording sheet comprises an approach limiting means that limits the approach of the thermal print head to the platen and determines a minimum distance between the thermal print head and the platen. The approach limiting means is provided with a stopping member for stopping the thermal print head or a print head holding member holding the thermal print head moving toward the platen to limit the approach of the thermal print head to the platen and to determine a minimum distance between the thermal print head and the platen. The thermal printer reduces the bias of distribution of the pressure of the thermal print head on the recording sheet along the width of the same and is capable of printing characters and the like clearly over the entire width of the recording sheet.

34 Claims, 11 Drawing Sheets

THERMAL PRINTER

BACKGROUND OF THE INVENTION

1. Field of the Invention

The present invention relates to a thermal printer provided with a thermal print head that forms characters and, more specifically, to a thermal printer provided with a thermal print head and capable of adjusting the pressure for pressing the thermal print head against a platen and of correcting the distribution of the pressure along the width of the recording sheet.

2. Description of the Prior Art

A known thermal printer is provided with a thermal print head and a platen, compresses a recording sheet and a thermal transfer ribbon between the thermal head and the platen, and heats the heating elements of the thermal print head selectively to print characters on the recording sheet.

Another known thermal printer is provided with a thermal print head and a platen, compresses a thermal recording sheet between the thermal print head and the platen, and heats the heating elements of the thermal print head selectively to print characters on the thermal recording sheet.

When printing characters on a recording sheet by a thermal printer, the recording sheet must be positioned on the thermal printer with respect to the thermal print head. Thermal printers are classified roughly by recording sheet positioning system into those of a center-to-center alignment system, which position the recording sheet with its center line aligned with the center line of the thermal print head, and those of a side-to-side alignment system, which position the recording sheet with its left side edge coinciding with the left end of the thermal print head.

In the thermal printer of the center-to-center alignment system, the distribution of pressure applied to the thermal print head to press the heating elements of the thermal head closely against the recording sheet on the recording sheet varies in inverse proportion to the distance along the width of the recording sheet, i.e., the width of the recording sheet along a direction perpendicular to the sheet feed direction, from the point of action of the pressure on the thermal print head and the pressure is not concentrated locally when the width of the recording sheet is changed.

When a recording sheet 2s of a width smaller than a standard width is used on the thermal printer of the side-to-side alignment system constructed so as to distribute the pressure applied to the thermal print head uniformly with respect to a width of a recording sheet of the standard width, the pressure distribution increases from a point at the reference edge 2a of the recording sheet 2s toward a point at the edge 2b opposite the reference edge 2a (hereinafter referred to as "free edge 2b") of the recording sheet 2s as shown in FIG. 13. When a recording sheet of a width greater than the standard width is used on the thermal printer of the side-to-side alignment system, the pressure distribution decreases from a point at the reference edge 2a toward a point at the free edge 2b. Such a biased pressure distribution affects adversely print quality and sheet feed performance because the heating elements of the thermal print head along the width of the recording sheet are not pressed uniformly against the recording sheet.

As shown in FIG. 14, when a recording sheet 2ss of a very small width is positioned on the thermal printer in side-to-side alignment and the free edge 2b is unable to reach a position corresponding to the point f of action of the pressure F, the pressure is distributed in a biased pressure distribution and, in some cases, a platen 3 is not uniformly deformed with respect to its axis. In such a case, it is possible that the free end of a thermal print head 1 comes into contact with the platen 3, which may cause abnormal abrasion of the platen 3, and increases the frictional resistance against the rotation of the platen 3 and increases the driving force necessary for rotating the platen 3.

Generally, the biased pressure distribution is due to the positional relation between the points of action of pressures applied to the thermal print head by springs, and the center line of the recording sheet with respect to the width. If the distribution of the points of action of pressures applied to the thermal print head by the springs is irregular with respect to the center line of the recording sheet, a moment acts on the thermal print head and the pressures are distributed in a biased pressure distribution so as to balance the moment. Support parts for supporting the thermal print head and the platen must have rigidities sufficient for supporting the thermal print head and the platen in a predetermined positional relation and the positional relation between the support parts must be controlled properly to support the thermal print head with the linear arrangement of its heating elements in parallel to the center axis of the platen during printing, operation. Most commercial printers, such as thermal printers, available on the market incorporate various devices to regulate the positional relation between the support parts for determining the positional relation between the print head and the platen.

A printer disclosed in JP-A (Japanese Patent Laid-open (Kokai)) No. 3-278977 has a platen supported by a pair of support members on a case, a top plate hinged to the case, a thermal print head attached to the lower surface of the top plate so that the thermal print head can be moved toward and away from a platen, and a holding member having an upper end pivotally joined to the lower surface of the top plate and a lower end provided with a connecting portion having a shape resembling the inverted letter C. When operating the printer for printing operation, the holding portion of the holding member is brought into engagement with a bearing supporting the platen to hold the top plate at a predetermined distance from the platen in order that the thermal print head is held in parallel to the platen.

A print head pressing mechanism for applying a pressure to a thermal print head disclosed in JP-A No. 5-155101 restrains the thermal print head from touching the platen to prevent the abrasion of the platen. This print head pressing mechanism has a print head holding means for holding the thermal print head so as to be moved toward and away from the platen. The print head holding means shifts the thermal print head away from the platen from its normal position when a recording sheet having a comparatively large thickness is used for recording. When a recording sheet having a comparatively small width is set on the printer in side-to-side alignment, the thermal print head is displaced away from the platen, inclined according to the thickness of the recording sheet, so that a portion of the thermal print head extending beyond the free edge of the recording sheet may not come into contact with the platen and may not abrade the platen.

A print head pressing mechanism disclosed in JU-A (Japanese Utility Model Laid-open (Kokai)) No. 5-58311 and applied to practical use prevents the direct contact of a thermal print head with a platen. This print head pressing mechanism moves a plurality of cams which are moved in a group by a cam moving member to set a plurality of pressing springs arranged symmetrically with respect to the middle of the thermal print head selectively in a working state; that is, only the pressing springs on one side of the middle of the thermal print head, only the pressing springs on the other side of the middle of the thermal print head or all the pressing springs are set in a working state. When a recording sheet of a comparatively small width is positioned relative to the platen on the thermal printer of the side-to-side system in side-to-side alignment, the cams are shifted so that the pressing springs on the side of the reference edge of the recording sheet with respect to the middle of the thermal print head exert pressure on the thermal print head to print characters clearly and to prevent the contact of the thermal print head with the platen. Most print head pressing mechanisms of this type are capable of adjusting the respective pressures of the pressing springs.

However, as mentioned above, the support parts supporting the thermal print head must have sufficient rigidities for supporting the thermal print head so that the parallelism between the linear arrangement of the heating elements of the thermal print head and the center axis of the platen is maintained in a range that will not cause irregular printing and contact between the thermal print head and the platen. Each of the support parts must have a comparatively large thickness and must be formed in a shape suitable for securing a sufficient rigidity to provide each support part with a sufficient rigidity, which increases the weight and the size of the thermal printer.

Although the print head pressing mechanism that holds the thermal print head by the print head holding means so as to be movable toward and away from the platen is capable of effectively preventing a biased pressure distribution, this print head pressing mechanism is complex and makes the miniaturization and the weight reduction of the thermal printer difficult. The print head pressing mechanism that moves the plurality of cams by the cam moving member to use the plurality of pressing springs selectively is complex and makes the miniaturization and the weight reduction of the thermal printer.

SUMMARY OF THE INVENTION

Accordingly, it is an object of the present invention to provide a thermal printer capable of applying pressure in an only slightly biased pressure distribution to a recording sheet, such as a tag or a label, regardless of the width of the recording sheet, by a thermal print head even if the recording sheet is set thereon in a side-to-side alignment, and of clearly printing characters over the entire width of the recording sheet.

Another object of the present invention is to provide a thermal printer having a platen and a thermal print head supported so that any portion of the thermal print head may not come into contact with the platen even if a recording sheet of a comparatively small width is set thereon in a side-to-side alignment.

A further object of the present invention is to provide a thermal printer having a simple mechanism and a compact, lightweight construction.

With the foregoing objects in view, the present invention provides a thermal printer that presses a thermal transfer ribbon and a recording sheet, or a thermal recording sheet, against a platen with a thermal print head to feed the thermal transfer ribbon and the recording sheet, or the thermal recording sheet, and drives the thermal print head for heat generation to record characters on the recording sheet or the thermal recording sheet. The thermal printer is provided with an approach limiting means that limits the approach of the thermal print head to the platen.

Suppose that the thermal printer is of the side-to-side alignment system and is constructed so that the pressure of the thermal print head is distributed uniformly along a direction parallel to the axis of the platen, i.e., along a direction perpendicular to the sheet feed direction, when a recording sheet of a standard width is set thereon in a side-to-side alignment. Then, the pressure that acts on a portion of a recording sheet at the side of the free edge increases when the width of the recording sheet is smaller than the standard width. Consequently, the thermal print head tends to tilt. However, since the approach limiting means limits the approach of a portion of the thermal print head at the side of the free edge of the recording sheet, a reaction force corresponding to an increase in the pressure of the portion of the thermal print head at the side of the free edge of the recording sheet balances a moment acting on the thermal print head. Therefore, the pressure of the thermal print head can be uniformly distributed over the entire width of the recording sheet and the bias of the pressure distribution is reduced.

Since the increase in the force acting on the recording sheet is reduced by the pressure and the reaction force and the balance of the distributed pressure, when the recording sheet has a comparatively small width, the change of the distributed pressure attributable to the change of the width of the recording sheet is comparatively small.

The approach limiting means for limiting the approach of the thermal print head to the platen may be a stopping member that stops the thermal print head or a print head holding member holding the thermal print head to limit the approach of the thermal print head to the platen directly or indirectly. The minimum distance between the thermal print head and the platen can be determined simply by determining a limit position of the thermal print head or the print head holding member relative to the platen with respect to the direction of action of the pressure of the thermal print head. Therefore, mechanisms associated with the thermal print head and the platen are simple and do not place restrictions on sheet passages and the like.

The approach limiting means may be such as having an axially movable position adjusting member that determines directly or indirectly the minimum distance between the thermal print head and the platen with respect to the direction of action of the pressure of the thermal print head. The axially movable member of the approach limiting means stops the movement of the thermal print head or the print head holding member toward the platen to determine the minimum distance between the thermal print head and the platen with respect to the direction of action of the pressure of the thermal print head on the platen, so that the approach of the thermal print head to the platen is limited. Since the axially movable position adjusting member of the approach limiting means is disposed coaxially with the platen to limit the approach of the thermal print head to the platen directly, i.e., to determine the minimum distance between the thermal print head and the platen without using other intermediate parts, the minimum distance between the thermal print head and the platen can be accurately determined without being affected by the accuracies of other parts.

The approach limiting means may be such as having a turnable position adjusting member having a circumference that determines directly or indirectly the minimum distance between the thermal print head and the platen with respect to the direction of action of the pressure of the thermal print head on the platen. Since the thermal print head or the print head holding member comes into contact with a portion of the turnable position adjusting member and the movement of the thermal print head toward the platen is limited by the turnable position adjusting member, the minimum distance between the thermal print head and the platen can be accurately determined.

The thermal printer may be provided with a print head stopping position adjusting means for adjusting the print head stopping position determined by the stopping member serving as the approach limiting means to properly adjust the print head stopping position defining the minimum distance between the thermal print head and the platen according to the thickness of the recording sheet. Thus, characters can be clearly printed on the recording sheet regardless of the thickness of the recording sheet.

The thermal printer may be provided with an approach limiting means having an axially movable position adjusting member for adjusting the minimum distance between the thermal print head and the platen with respect to the direction of action of the pressure of the thermal print head on the platen.

The thermal printer may be provided with an approach limiting means having a turnable position adjusting member for adjusting the minimum distance between the thermal print head and the platen with respect to the direction of action of the pressure of the thermal print head on the platen.

The adjustment of the minimum distance between the thermal print head and the platen can be achieved by any one of these approach limiting means to print characters clearly regardless of the thickness of the recording sheet.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

The effect of the present invention will be described with reference to FIG. 4 prior to the description of thermal printers embodying the present invention illustrated in FIGS. 1A, 1B, 2, 5A, 5B and the rest to make the points of the present invention clear.

A dynamic model shown in FIG. 4 will be explained on an assumption that a pressure F applied to a thermal print head 1 is transmitted entirely through a recording sheet 2 to a platen 3, and all the forces and moments acting in this system are balanced.

Figure 4:
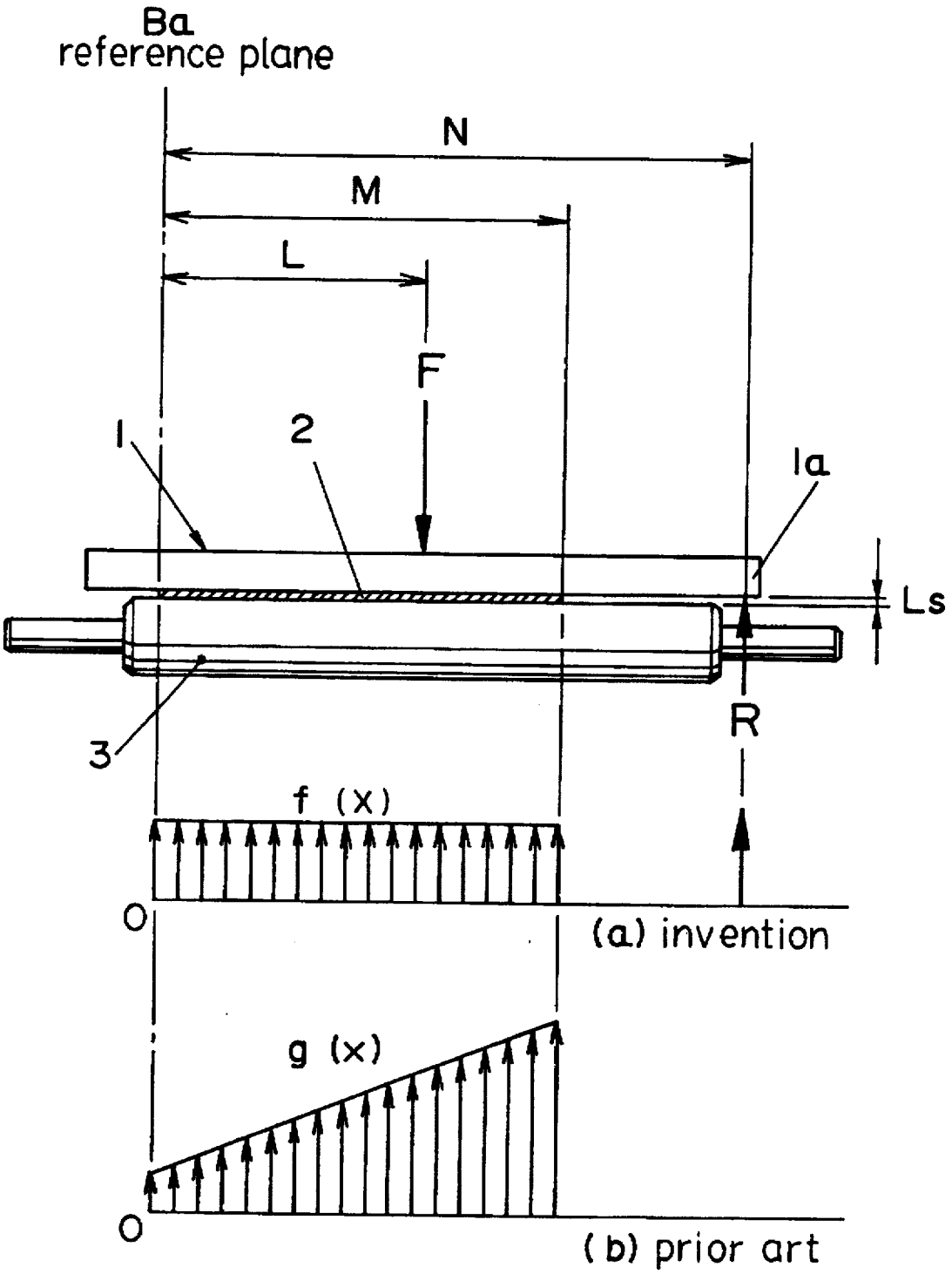
FIG. 4 is a diagrammatic view of a simple dynamic model of assistance in explaining the printing pressure correcting action of the thermal printer in accordance with the present invention.

Referring to FIG. 4, the width M of the recording sheet 2 is measured along a direction perpendicular to a sheet feed direction. Suppose that the pressure F is distributed along the width of the recording sheet 2 in a distribution curve expressed by a function f(x). When forces acting in the direction of action of the pressure F balance, $$F = \int_0^M f(x)dx + R = wM + R \tag{1}$$

where R is a reaction force that acts on the free end 1*a* of the thermal print head 1 to determine the minimum distance Ls between the thermal print head 1 and the platen 3, and w is a constant, because f(x)=w.

Suppose that L is the distance from a reference plane Ba to the point of action of the pressure F, and N is the distance from the reference plane Ba to the point of action of the reaction force R. Then, the balance of the moments with respect to a point x=0 is expressed by:

$$F \cdot L = \frac{1}{2} M^2 \cdot w + N \cdot R \tag{2}$$

From expressions (1) and (2), $$w = \frac{2(L-N)}{M(M-2N)} F \tag{3}$$

$$R = \frac{(2L-M)}{2N-M} F \tag{4}$$

The distribution of a pressure on a recording sheet 2 in a thermal printer not embodying the present invention is represented by a function g(x) supposed to be a linear expression.

$$g(x)=ax+b \tag{5}$$

Expression (5) is a satisfactory approximate expression in a range where the deformation of the platen 3 is linear. The balance of forces acting in the direction of action of the pressure F is expressed by:

$$F=\int_0^M g(x)dx=\frac{a}{2}M^2+bM \tag{6}$$

Conditions for the balance of moments with respect to a point x=0 are expressed by:

$$F\cdot L=\int_0^M x\cdot g(x)dx=\frac{a}{3}M^3+\frac{b}{2}M^2 \tag{7}$$

Values of coefficients a and b are determined from expressions (6) and (7), and substituting the values of coefficients a and b into expression (5), $$g(x)=\frac{6F(2L-M)}{M^3}x+\frac{2F(2M-3L)}{M^2} \tag{8}$$

Expressions (5), (6), (7) and (8) are formed when L<M. When M<L, i.e., when the width of the recording sheet 2 is very small, the free end 1*a* of the thermal head 1 comes into direct contact with the platen 3 and, consequently, the pressure F is not distributed and is concentrated on the right end, as viewed in FIG. 4 (concentrated loading). If the pressure F is distributed uniformly over the entire width of the recording sheet 2, partial pressure w' is expressed by:

$$w'=\frac{F}{M} \tag{9}$$

Figure 3:
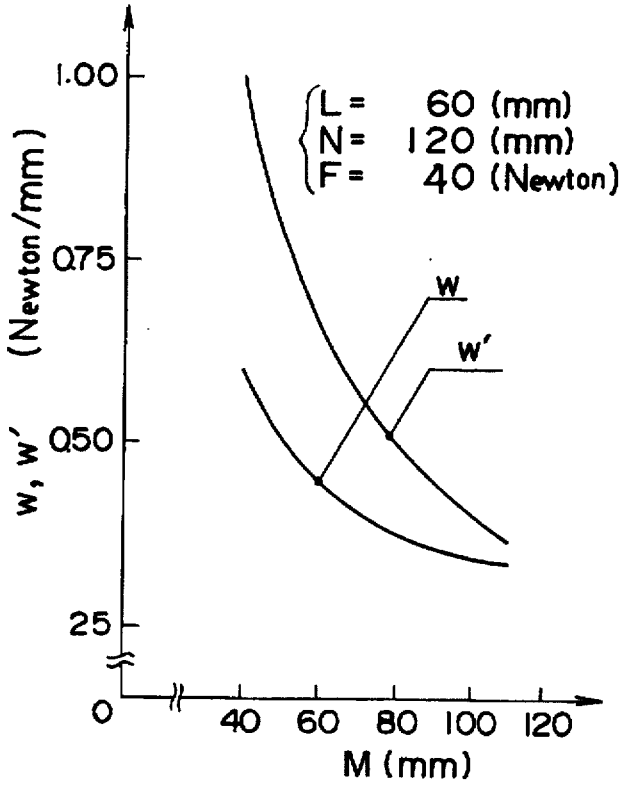
FIG. 3 is a graph comparatively showing the distribution of the pressure of a thermal print head on a platen in a thermal printer in accordance with the present invention and that of the pressure of a thermal print head on a platen in a conventional thermal printer.

FIG. 3 shows the partial pressures w and w' for the width M of the recording sheet in the range of 40 to 110 mm, calculated by using expressions (3) and (9), when the distance L from the reference plane Ba to the point of action of the pressure F is 60 mm, the distance N from the reference plane Ba to the point of action of the reaction force R is 120 mm, and the pressure F is 40 Newton.

In the most ideal state, the partial pressures w and w' are equal to a predetermined partial pressure suitable for printing, regardless of the width M of the recording sheet. As is obvious from FIG. 3, the partial pressure w' for M=40 mm is about three times the partial pressure w' for M=110 mm in the thermal printer not embodying the present invention, whereas the partial pressure, while the partial pressure w for M=40 mm, is about twice the partial pressure w for M=110 mm in the thermal printer of the present invention.

The present invention thus holds the free end 1*a* of the thermal print head 1 to produce the reaction force R for adjusting the minimum distance Ls between the thermal print head 1 and the platen 3 according to the thickness of the recording sheet 2, so that the biased distribution of the pressure over the entire width of the recording sheet can be improved. Accordingly, the thermal printer is able to print characters uniformly with a satisfactory print quality over the entire width of the recording sheet 2 regardless of the width M of the recording sheet 2. Since the change of the partial pressure w due to the change of the width M of the recording sheet 2 is small, the partial pressure w is in an appropriate range for the width M of the recording sheet in a wide range.

Mechanisms employed in the thermal printer in accordance with the present invention to produce the reaction force R for correcting the pressure distribution will be described below in connection with the preferred embodiments of the present invention.

Figure 1A:
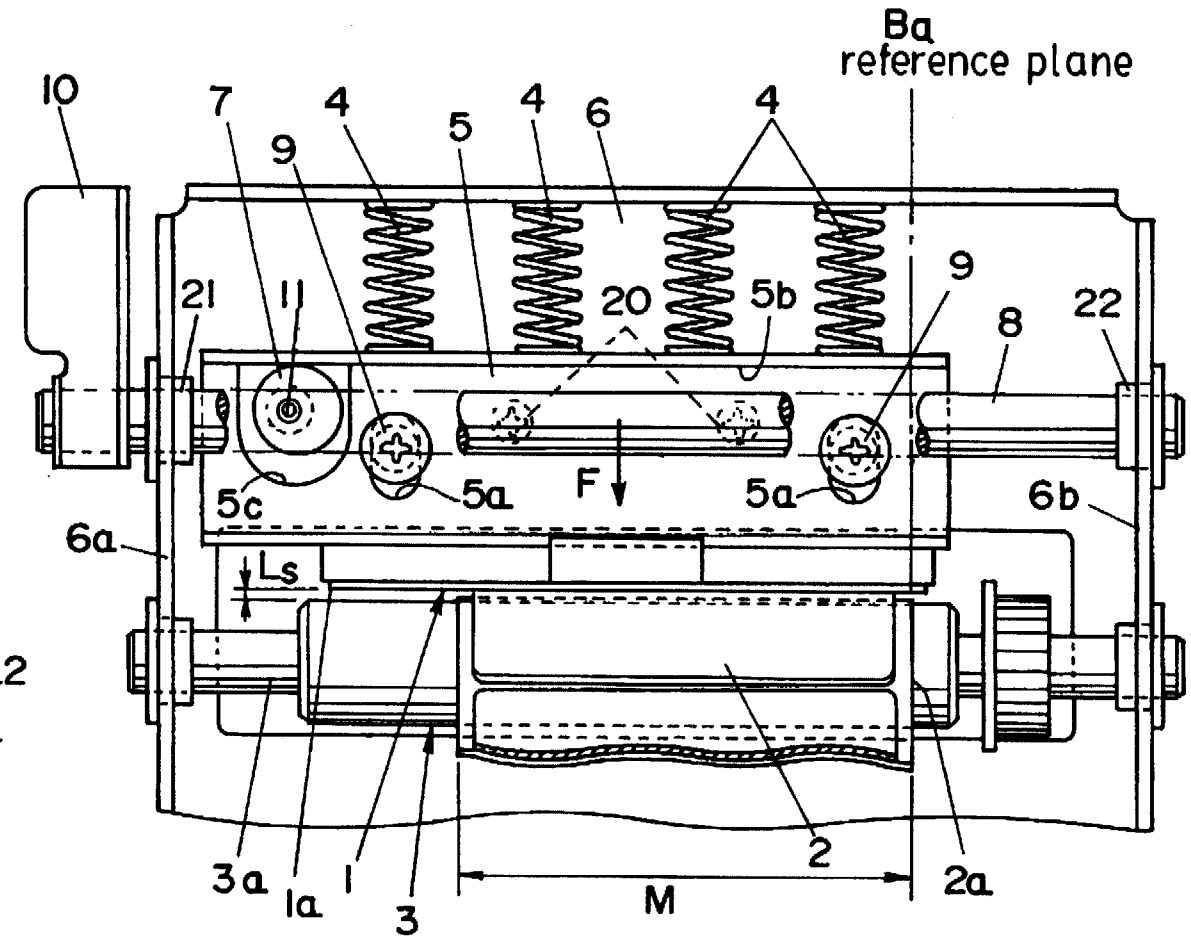
FIGS. 1A and 1B are a fragmentary front view and a fragmentary side view, respectively, of a thermal printer in a first embodiment according to the present invention as set in a printing position.
Figure 1B:
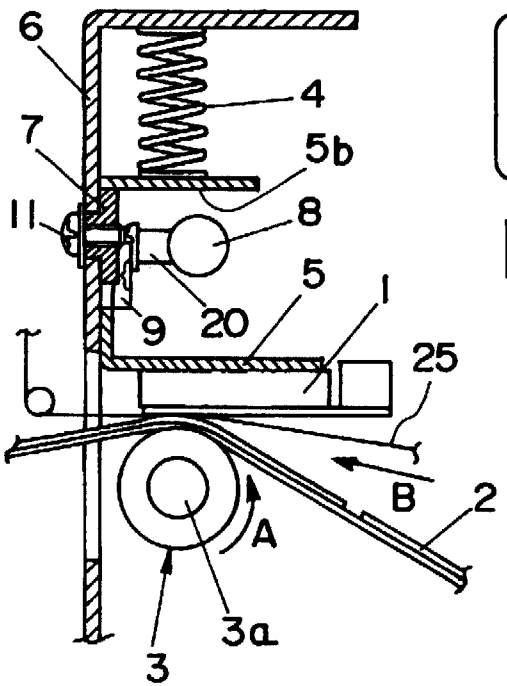
Figure 2:
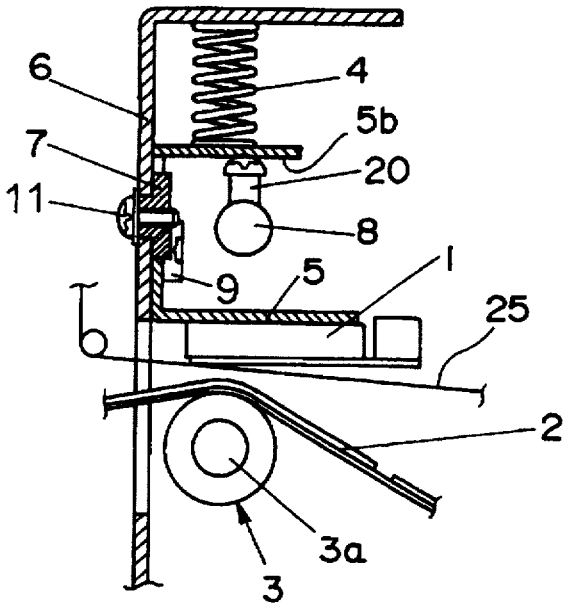
FIG. 2 is a side view of the thermal printer of FIGS. 1A and 1B as set in a standby position.

First Embodiment (FIGS. 1A, 1B, 2)

Shown in FIGS. 1A and 1B is a thermal printer of a side-to-side alignment system that requires a recording sheet 2 to be set thereon with the one side edge, a reference edge 2*a*, of the recording sheet 2 included in a reference plane Ba regardless of the width M of the recording sheet 2. When setting the recording sheet 2*a* on the thermal printer, the reference edge 2*a* of the recording sheet 2 is abutted against the guide surface of a guide member, not shown, in alignment with the reference plane Ba. The thermal printer has a thermal print head 1 and a platen 3. The thermal print head 1 is fastened to the lower surface of a print head holding member 5 formed by bending a plate and supported for vertical movement, as viewed in FIG. 1A, on a main frame 6. The shaft 3*a* of the platen 3 is supported for rotation in bearings on the opposite side walls 6*a* and 6*b* of the main frame 6. As shown in FIG. 1B, the shaft 3*a* of the platen 3 is driven for rotation by a driving mechanism, not shown. The recording sheet 2 and a thermal transfer ribbon 25 are compressed between the thermal print head 1 and the platen 3, and the platen 3 is rotated in the direction of the arrow A to feed the recording sheet 2 and the thermal transfer ribbon 25 in the direction of the arrow B. Heating elements, not shown, arranged transversely, as viewed in FIG. 1A, on the thermal print head 1 are selectively energized to print characters and the like on the recording sheet 2. The recording sheet 2 may be a thermal recording sheet that does not need any thermal transfer ribbon for printing.

The thermal printer is provided with an approach limiting mechanism, which will be described later, for determining a minimum distance Ls between the free end 1*a* of the thermal print head 1 and the platen 3. The approach limiting mechanism regulates a pressure applied by the thermal print head 1 to the platen 3 to print characters and the like evenly in a satisfactory print quality.

The thermal print head 1 is pressed against the platen 3 by a plurality of compression coil springs 4, namely, four compression coil springs 4 in this embodiment, extended between the main frame 6 and the print head holding member 5 holding the thermal print head 1. The total pressure F of the compression coil springs 4 is applied through the print head holding member 5 to the thermal print head 1 to press the thermal print head against the platen 3. The direction of action of the pressure F is a platen pressing direction.

The print head holding member 5 has provided in its back wall with transversely spaced vertical slots 5*a*, and step screws 9 are screwed through the slots 5*a* in threaded holes formed in the back wall of the main frame 6 to guide the print head plate 5 for vertical movement as viewed in FIGS. 1A and 1B. A print head raising shaft 8 is supported for rotation in bearings 21 and 22 on the opposite side walls 6*a* and 6*b* of the main frame 6, and a lever 10 is fixed to the left end, as viewed in FIG. 1A, of the print head raising shaft 8. Two step screws 20 are screwed in the middle portion of the print head raising shaft 8 at transversely spaced positions so as to project radially from the print head raising shaft 8. As the lever 10 is turned to turn the print head raising shaft 8 to an angular position shown in FIG. 2, the heads of the step screws 20 come into contact with the lower surface of the upper wall 5*b* of the print head holding member 5 to raise the print head holding member 5 to a position shown in FIG. 2. Consequently, the thermal print head 1 is separated from the platen 3, and the pressure F acting on the platen 3 is removed.

As mentioned above, the thermal printer is provided with the approach limiting mechanism to determine the minimum distance Ls between the thermal print head 1 and the platen 3. The approach limiting mechanism serves also as a minimum distance determining means for determining the minimum distance between the thermal print head 1 and the platen 3. In the first embodiment, the approach limiting mechanism comprises an eccentric disk 7 and a screw 11. The eccentric disk 7 is fastened to the back wall of the main frame 6 with the screw 11 so that the upper wall 5*b* of the print head plate 6 comes into contact with the eccentric disk 7 when the thermal print head 1 is moved toward the platen 3 to a position where the working surface of the thermal print head 1 is at the minimum distance Ls from the platen 3. An opening 5*c* is formed in the back wall of the print head holding member 5 to avoid interference between the print head holding member 5 and the eccentric disk 7. The angular position of the eccentric disk 7 can be changed by loosening the screw 11 and turning the eccentric disk 7 to adjust the minimum distance Ls according to the thickness of the recording sheet 2. After thus adjusting the angular position of the eccentric disk 7, the screw 11 is tightened again to fasten the eccentric disk 7 to the main frame 6. When the lower surface of the upper wall 5*b* of the print head holding member 5 comes into contact with the eccentric disk 7, a reaction force R as explained with reference to FIG. 4 is produced. When the thermal printer operates for printing with the lower surface of the upper wall 5*b* of the print head holding member 5 in contact with the eccentric disk 7, the pressure applied by the thermal print head 1 to the recording sheet 2 is distributed uniformly over the entire width of the recording sheet 2, so that characters and the like can be printed evenly in a satisfactory print quality.

Figure 5A:
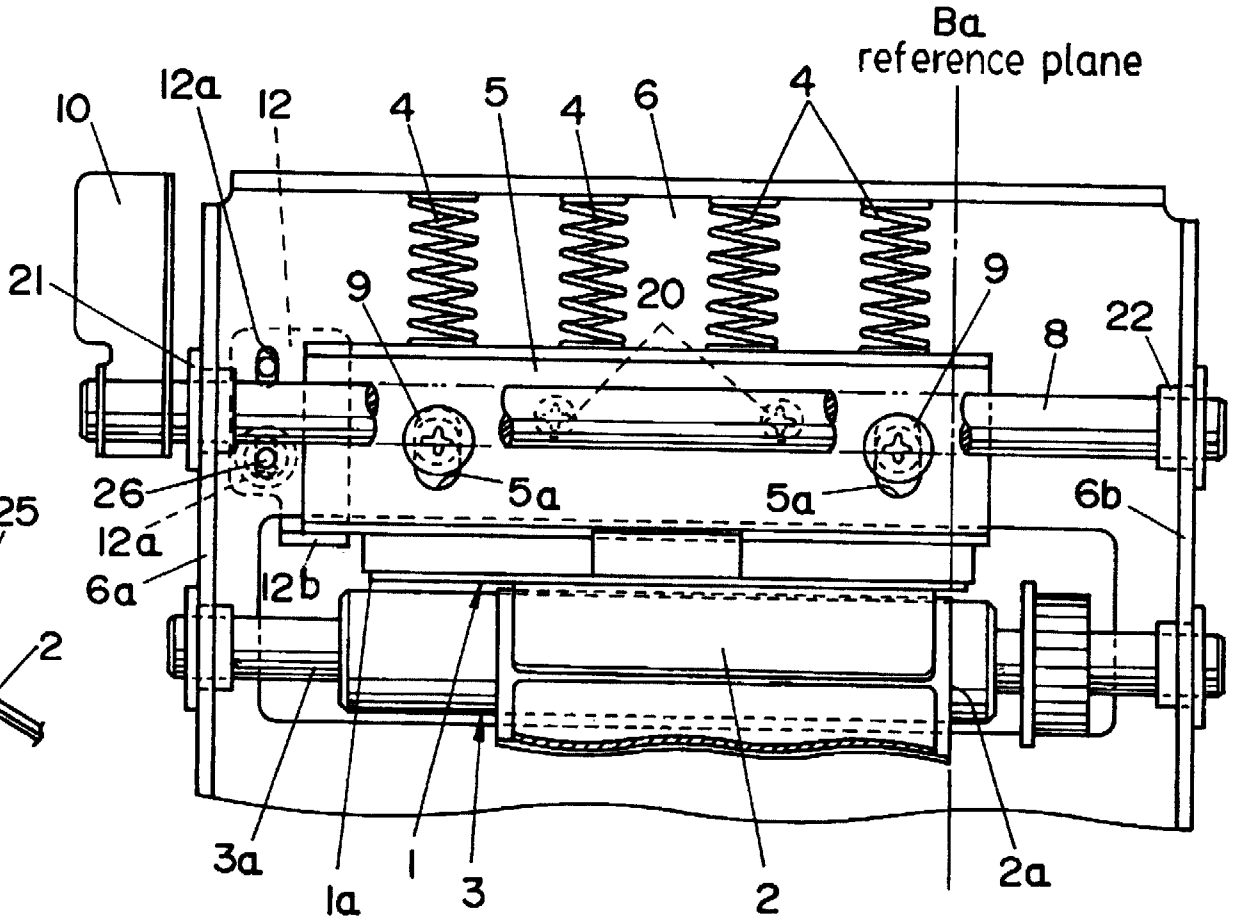
FIGS. 5A and 5B are a fragmentary front view and a fragmentary side view, respectively, of a thermal printer in a second embodiment according to the present invention as set in a printing position.
Figure 5B:
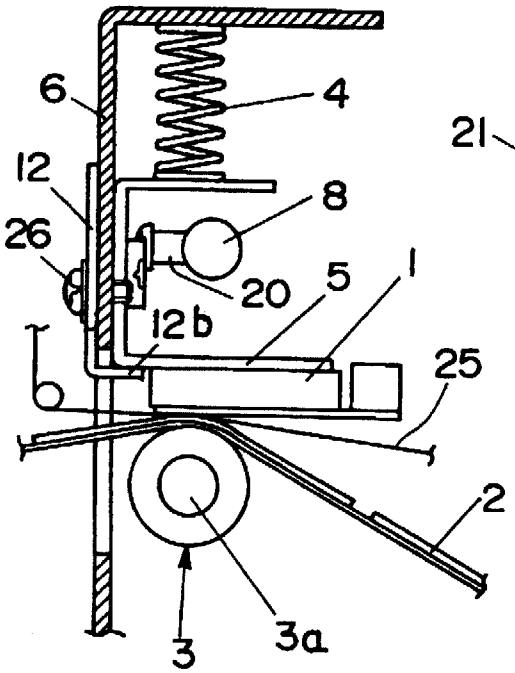
Figure 6:
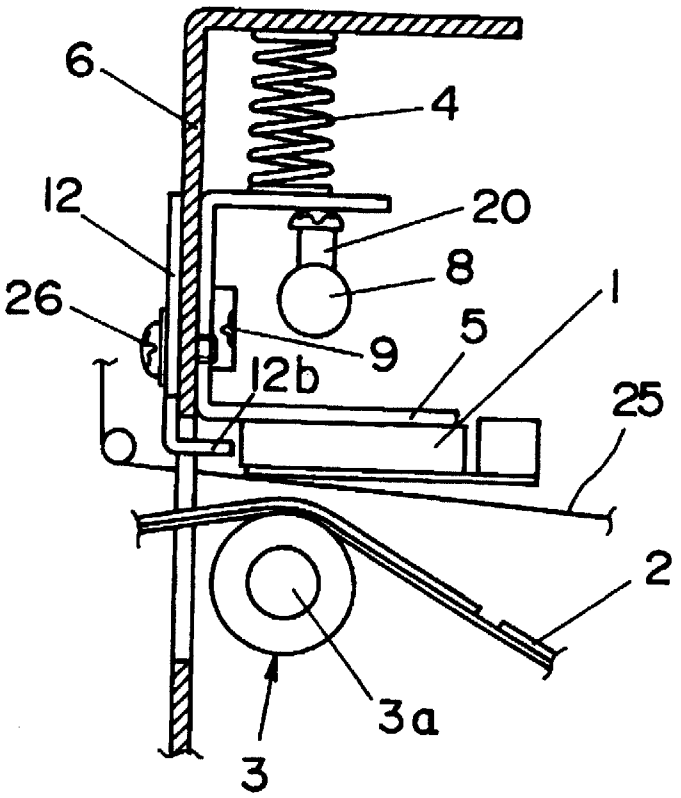
FIG. 6 is a side view of the thermal printer of FIGS. 5A and 5B as set in a standby position.

Second Embodiment (FIGS. 5A, 5B, 6)

A thermal printer in a second embodiment according to the present invention will be described with reference to FIGS. 5A, 5B and 6, in which parts like or corresponding to those shown in FIGS. 1A, 1B and 2 are designated by the same reference characters. The thermal printer in the second embodiment is substantially similar in construction to the thermal printer in the first embodiment.

The thermal printer in the second embodiment is provided with an approach limiting mechanism comprising an L-shaped bracket 12 and step screws 26 instead of the approach limiting mechanism shown in FIGS. 1A and 1B comprising the eccentric disk 7 and the screw 11. The bracket 12 has provided in its vertical wall with two transversely spaced vertical slots 12*a*, and the step screws 26 are screwed through the slots 12*a* into threaded holes formed in the back wall of a main frame 6 to fasten the bracket 12 at an appropriate vertical position on the back wall of the main frame 6. When the step screws 26 are loosened, the bracket 12 can be moved vertically as viewed in FIGS. 5A and 5B for positional adjustment in a range defined by the slots 12*a* on the outer surface of the back wall of the main frame 6. The bracket 12 has a stopping part 12*b* formed by bending the lower portion of the vertical portion thereof toward a thermal print head 1 held on a print head holding member 5. When print head holding member 5 holding the thermal print head 1 is lowered, the lower wall of the print head holding member 5 comes into contact with the stopping part 12*b*. Thus, the stopping part 12*b* limits the downward movement of the print head holding member 5 holding the thermal print head 1 to determine the lowermost position of the free end 1*a* of the thermal print head 1 indirectly. The bracket 12 is fastened to the back wall of the main frame 6 with the step screws 26 after properly adjusting the vertical position of the bracket 12 according to the thickness of the recording sheet 2. Thus, the function of the bracket 12 is similar to that of the eccentric disk 7 of the first embodiment.

Figure 7:
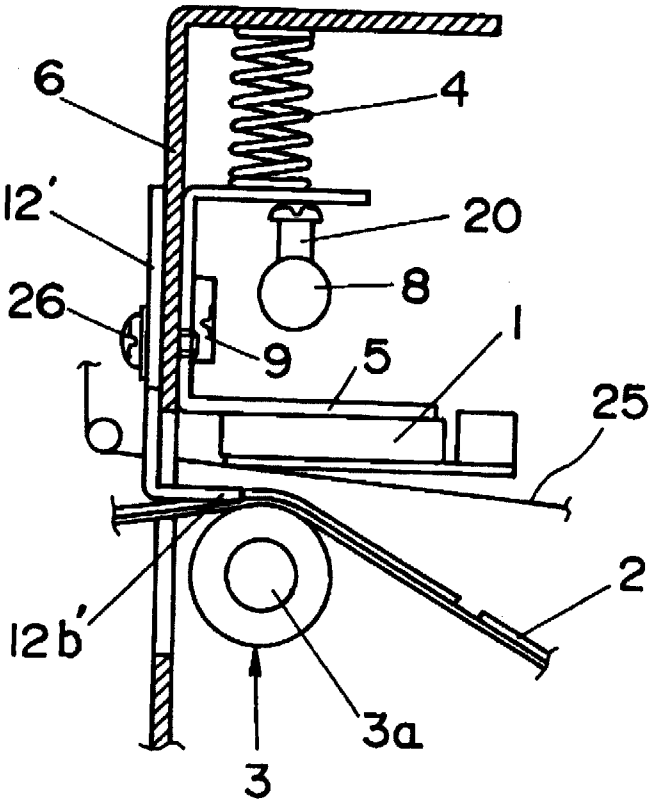
FIG. 7 is a fragmentary side view of a thermal printer in a third embodiment according to the present invention as set in a standby position.
Figure 8A:
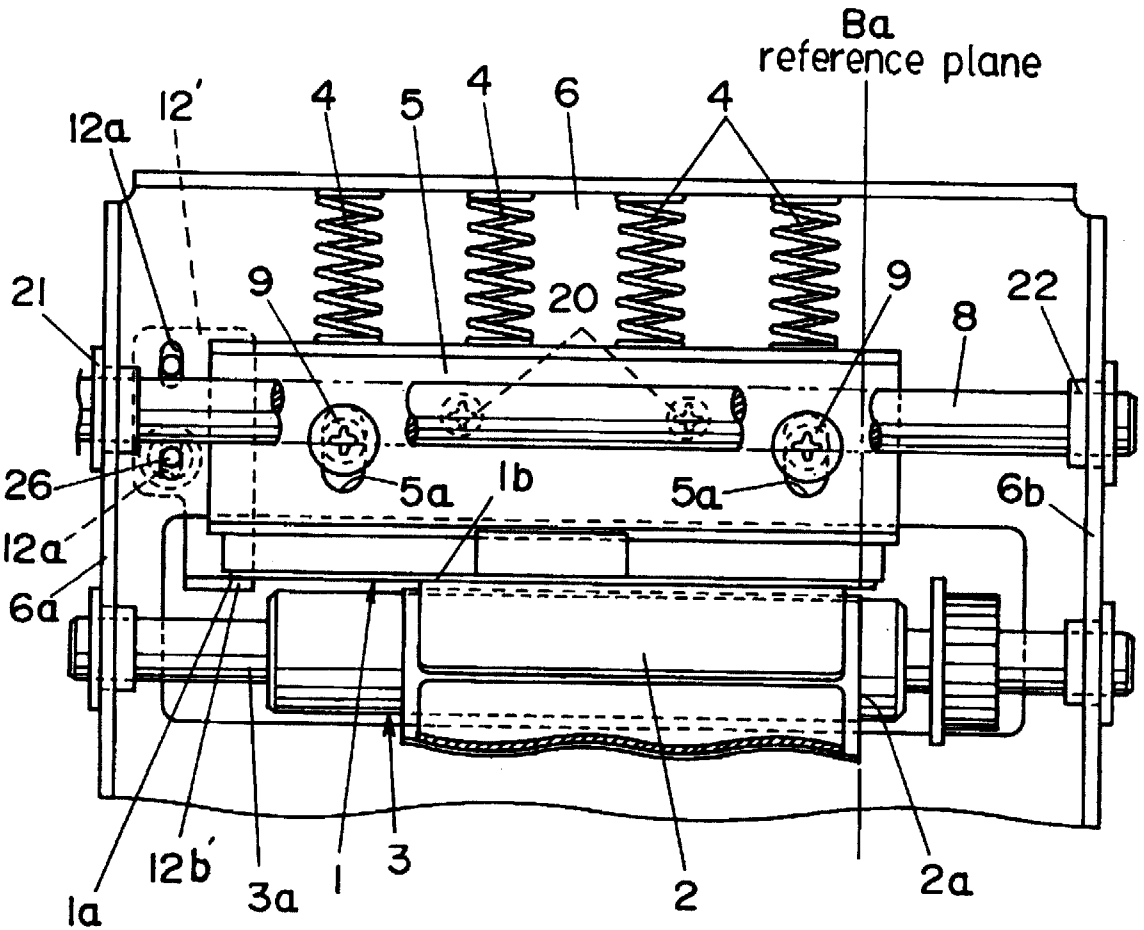
FIGS. 8A and 8B are a fragmentary front view and a fragmentary side view, respectively, of a thermal printer in the third embodiment as set in a printing position.
Figure 8B:
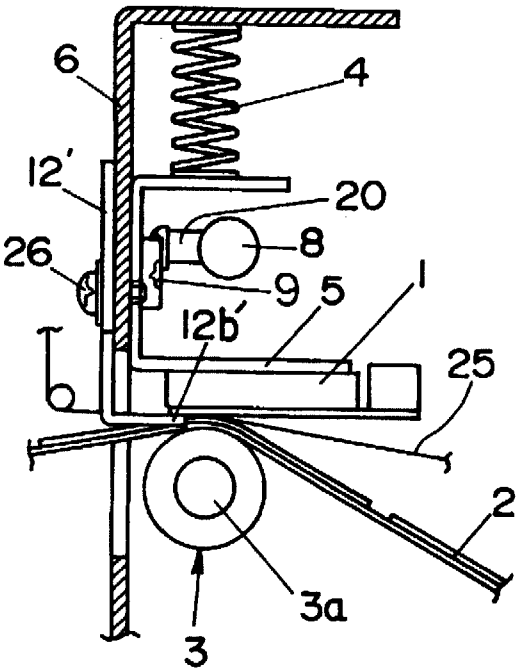

Third Embodiment (FIGS. 7, 8A, 8B)

A thermal printer in a third embodiment according to the present invention will be described with reference to FIGS. 7, 8A and 8B, in which parts like or corresponding to those shown in FIGS. 5A, 5B and 6 are designated by the same reference characters. The thermal printer in the third embodiment is substantially similar in construction to the thermal printer in the second embodiment.

Referring to FIGS. 7, 8A and 8B, the thermal printer is provided with an approach limiting mechanism comprising an L-shaped bracket 12' having a stopping part 12*b*', and step screws 26. The bracket 12' is formed so as to engage with the body 1*b* of a thermal print head 1 to determine the position of the free end 1*a* of the thermal print head 1. The bracket 12' is fastened to the back wall of a main frame 6 with the step screws 26 in a manner similar to that in which the bracket 12 of the second embodiment is fastened to the back wall of the main frame 6. When a print head holding member 5 holding the thermal print head 1 is moved toward a platen 3, the body 1*b* of the thermal print head 1 comes into direct contact with the stopping part 12*b*', whereby the movement of the print head holding member 5 toward the platen 3 is stopped. Thus, the thermal print head 1 is stopped accurately at the minimum distance Ls from the platen 3 without being affected by the dimensional accuracy of the print head holding member 5.

Figure 9:
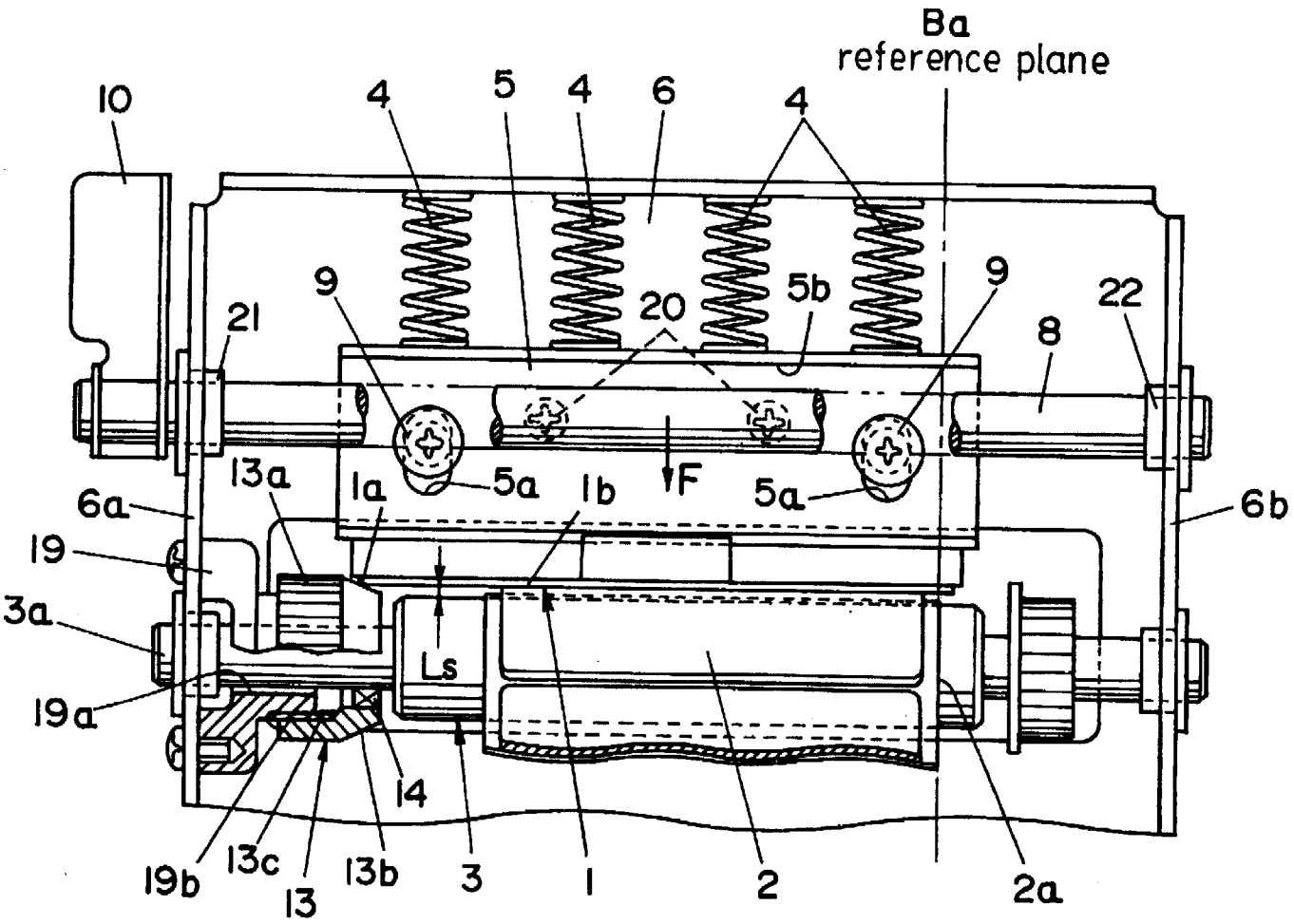
FIGS. 9, 10, and 11 are fragmentary front views of thermal printers in a fourth, a fifth and a sixth embodiment according to the present invention, respectively, as set in a printing position.

Fourth Embodiment (FIG. 9)

A thermal printer in a fourth embodiment according to the present invention will be described with reference to FIG. 9, in which parts like or corresponding to those shown in FIG. 1A are designated by the same reference characters. The thermal printer in the fourth embodiment is substantially similar in construction to the thermal printer in the first embodiment.

Referring to FIG. 9, the pressure F of compression coil springs 4 is applied to a print head holding member 5 holding a thermal print head 1 to press the thermal print head 1 against a platen 3. The thermal printer is provided with an approach limiting mechanism comprising a taper collar 13, and a axial position adjusting member 19. The taper collar 13 has a body portion 13*a* having an outer circumference provided with small ridges and an inner circumference provided with an internal thread 13*c*, and a taper portion 13*b* tapered toward the platen 3. The taper collar 3 is supported on a bearing mounted on the shaft 3*a* of the platen 3 so as to be rotatable relative to the shaft 3*a* of the platen 3. The axial position adjusting member 19 has a flange portion and a stub portion projecting from the flange portion and provided with an external thread 19*b* mating with the internal thread internal thread 13*c* of the taper collar 13, and is provided with a center bore 19*a* for loosely receiving the end portion of the shaft 3*a* of the platen 3. The axial position adjusting member 19 is disposed coaxially with the platen 3 receiving the end portion of the shaft 3*a* therein and is fastened to the side wall 6*a* of a main frame 6 with screws. The taper collar 13 is screwed on the externally threaded stub portion of the axial position adjusting member 19.

When the thermal print head 1 is moved toward the platen 3, the free end 1*a* of the body 1*b* of the thermal print head 1 comes into contact with the taper portion 13*b* of the taper collar 13. The axial position of the taper collar 13 is adjusted by turning the taper collar 13 on the stub portion of the axial position adjusting member 19 to move the taper collar 13 axially relative to the axial position adjusting member 19. The minimum distance Ls between the thermal print head 1 and the platen 3 is dependent on the axial position of the taper collar 13. Thus, the minimum distance Ls can be adjusted by turning the taper collar 13 according to the thickness of the recording sheet 2. Upon the direct contact of the thermal print head 1 with the taper collar 13, a reaction force R as explained with reference to FIG. 4 is produced.

Figure 10:
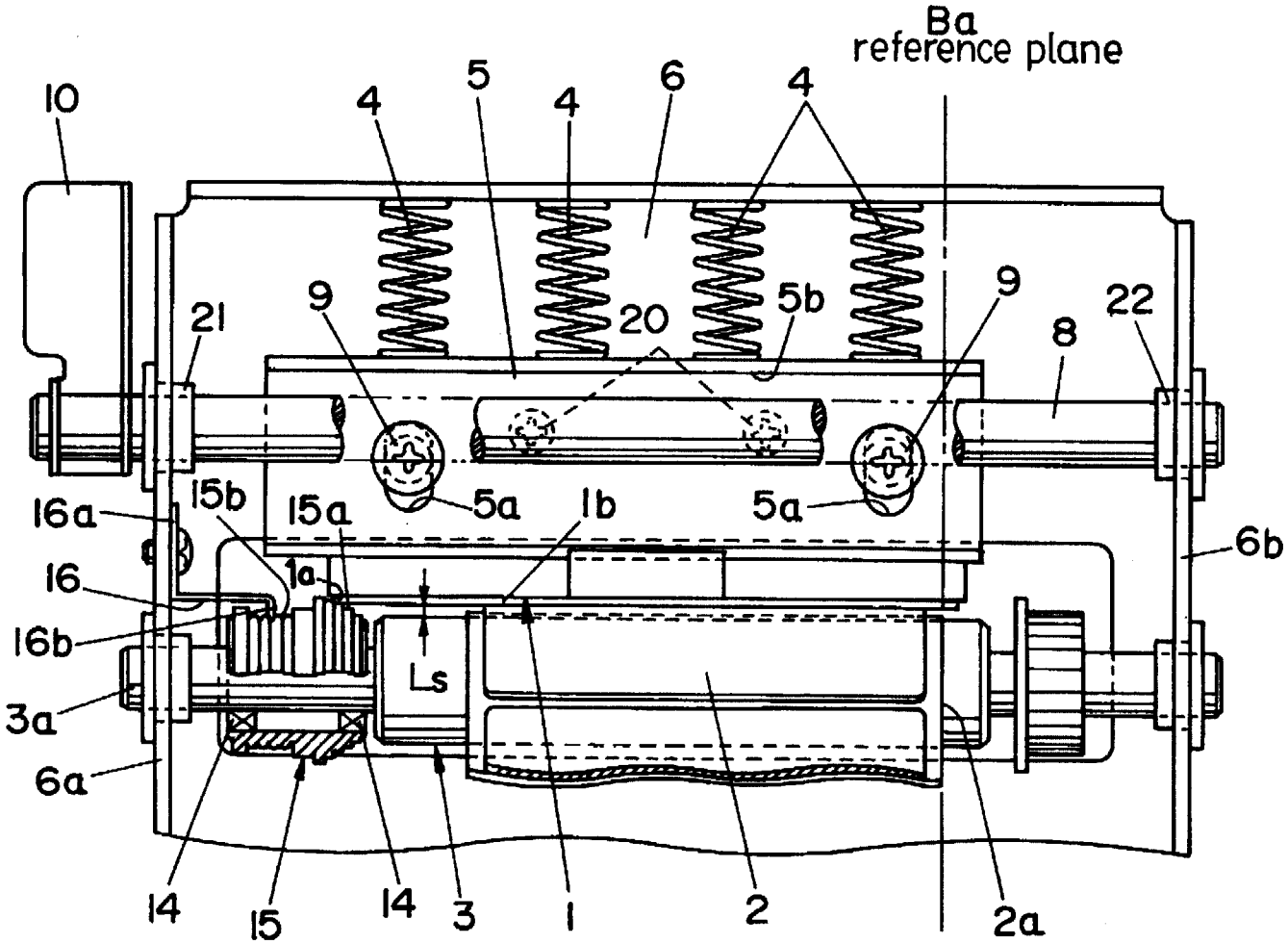

Fifth Embodiment (FIG. 10)

A thermal printer in a fifth embodiment according to the present invention will be described with reference to FIG. 10, in which parts like or corresponding to those shown in FIG. 9 are designated by the same reference characters. The thermal printer in the fifth embodiment is substantially similar in construction to the thermal printer in the fourth embodiment.

Referring to FIG. 10, the thermal printer is provided with an approach limiting mechanism comprising a stepped collar 15 mounted on the shaft 3*a* of a platen 3 coaxially with the platen 3, and a plate spring 16. The stepped collar 15 has a stepped portion 15*a* having steps stepped toward its extremity in decreasing order at predetermined pitches, and a grooved portion 15*b* provided in its outer circumference with annular grooves formed at pitches corresponding to those of the steps of the stepped portion 15*a*, and a central bore. The plate spring 16 has a base portion 16*a* fixed to the side wall of a main frame 6, and a free end 16*b* in engagement with one of the annular grooves of the grooved portion 15*b* of the stepped collar 15 to restrain the stepped collar 15 from rotating together with the platen 3. The axial position of the stepped collar 15 on the shaft 3*a* of the platen 3 is adjusted by releasing the stepped collar 15 from the plate spring 16 and axially moving the stepped collar 15 on the shaft 3*a* of the platen 3 and bringing the extremity 16*b* of the plate spring 16 into engagement with a desired annular groove of the grooved portion 16*b*.

The axial position of the stepped collar 15 relative to the platen 3 is adjusted to place a desired step of the stepped portion 15*a* at a position on a path along which the free end 1*a* of the thermal print head 1 moves toward the platen 3. Thus, the minimum distance Ls can be changed stepwise according to the thickness of the recording sheet 2. Upon the direct contact of the free end 1*a* of the thermal print head 1 with the desired step of the stepped portion 15*a* of the stepped collar 15, a reaction force R as explained with reference to FIG. 4 is produced, the minimum distance Ls between the free end 1*a* of the thermal print head 1 and the platen 3 is determined to improve the biased pressure distribution along the width of the recording sheet 2. Consequently, characters can be clearly printed on the recording sheet 2 in a satisfactory print quality over the entire width of the recording sheet.

Figure 11:
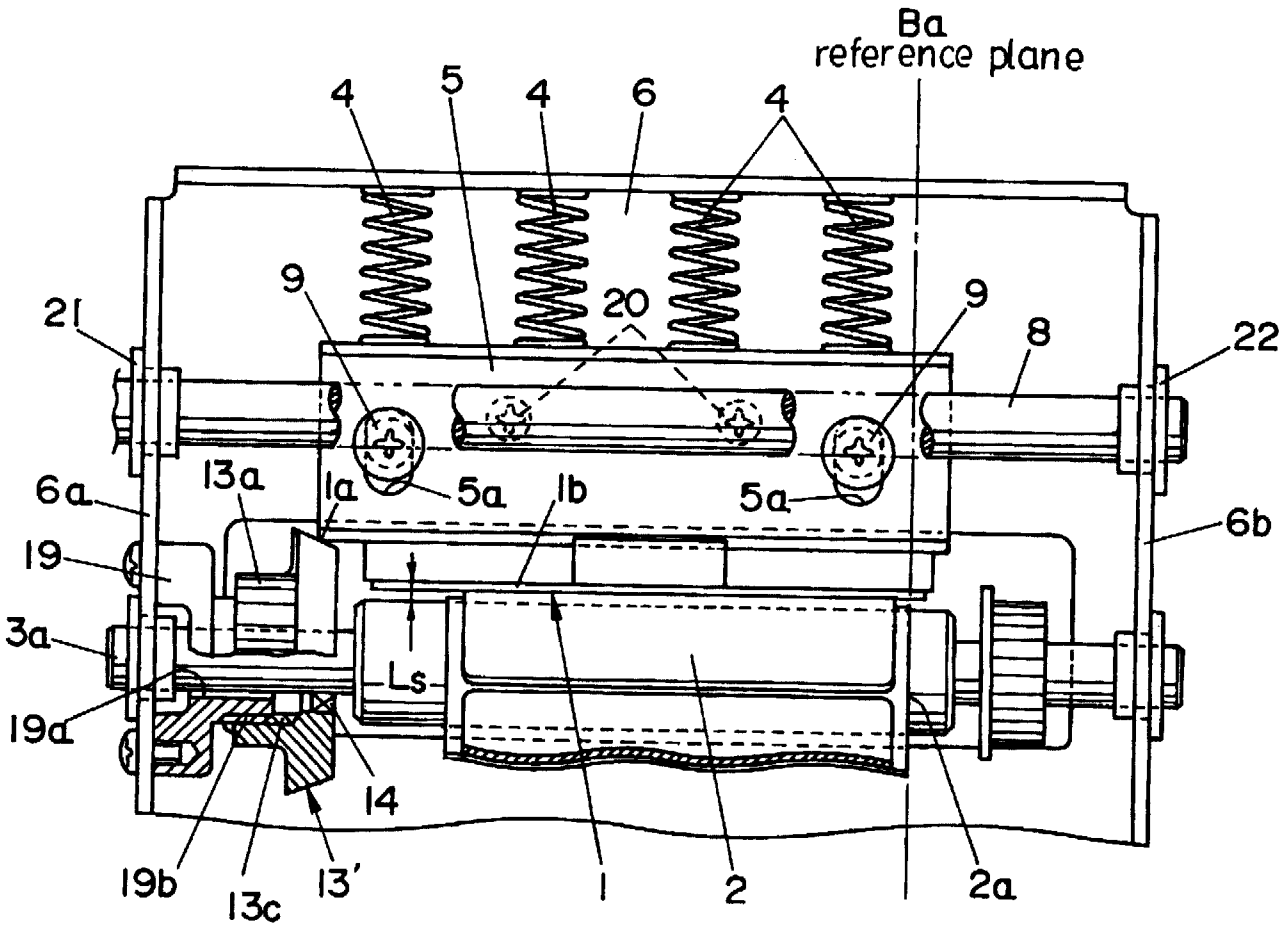

Sixth Embodiment (FIG. 11)

A thermal printer in a sixth embodiment according to the present invention will be described with reference to FIG. 10, in which parts like or corresponding to those shown in FIG. 9 are designated by the same reference characters. The thermal printer in the sixth embodiment is substantially similar in construction to the thermal printer in the fourth embodiment shown in FIG. 9.

Whereas the taper collar 13 of the fourth embodiment is disposed to determine a minimum distance Ls so that the body 1*b* of a thermal print head 1 comes into direct contact with the taper portion 13*b* of the taper collar 13 when thermal print head 1 is moved toward the platen 3, a taper collar 13' employed in the sixth embodiment is disposed to determine a minimum distance Ls so that a print head holding member 15 holding a thermal print head 1 comes into contact with the taper collar 13' when the print head holding member 15 holding the thermal print head 1 is moved toward a platen 3. Mechanisms associated with the thermal print head 1 in the sixth embodiment are simpler than those in the fourth embodiment shown in FIG. 9.

Figure 12A:
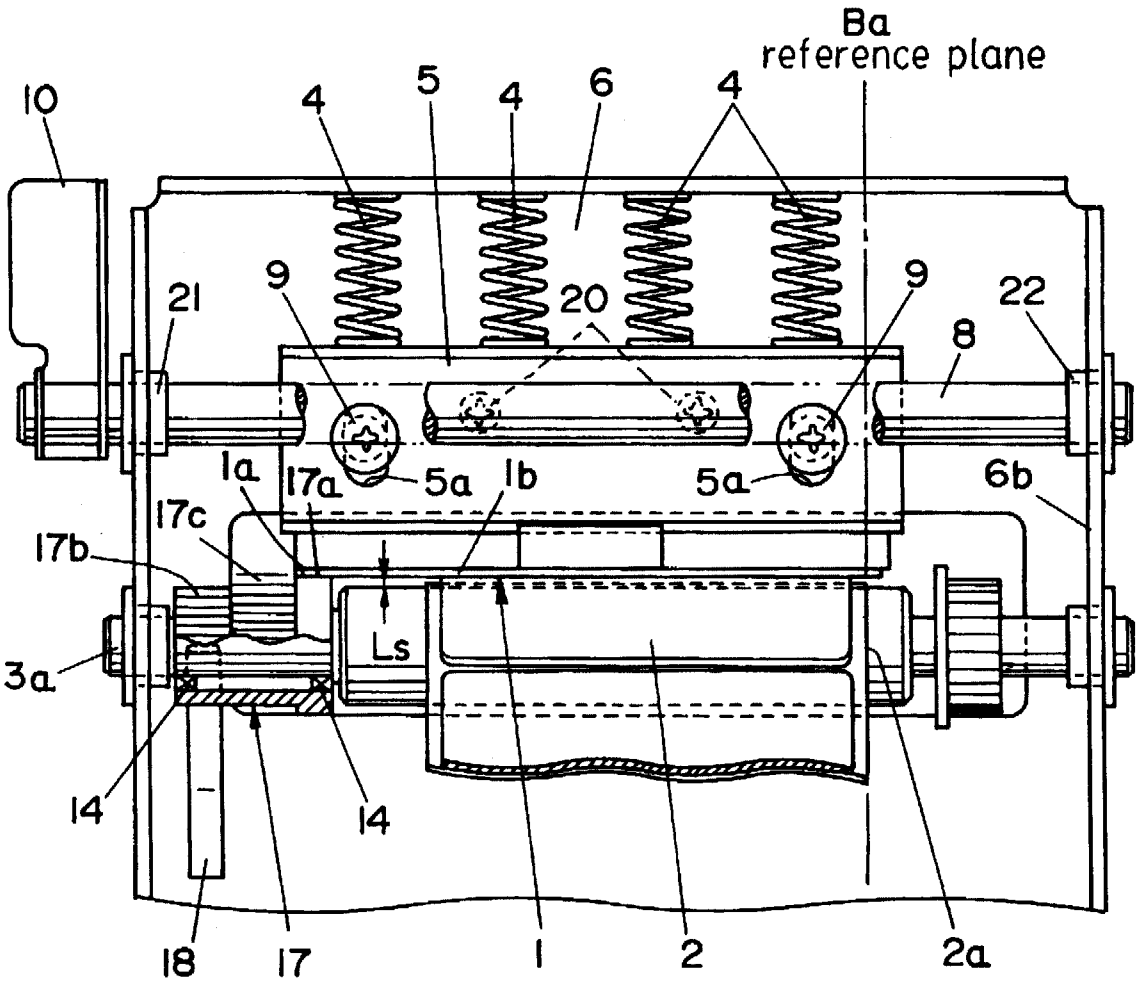
FIGS. 12A and 12B are a fragmentary front view and a fragmentary side view, respectively, of a thermal printer in a seventh embodiment according to the present invention as set in a printing position.
Figure 12B:
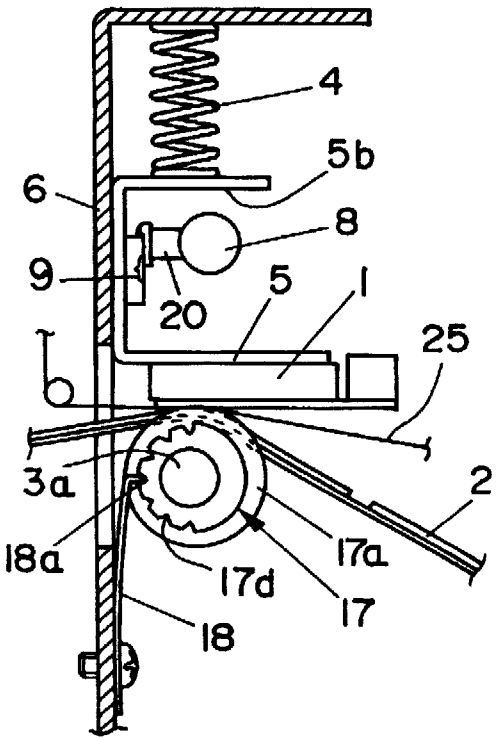
Figure 13:
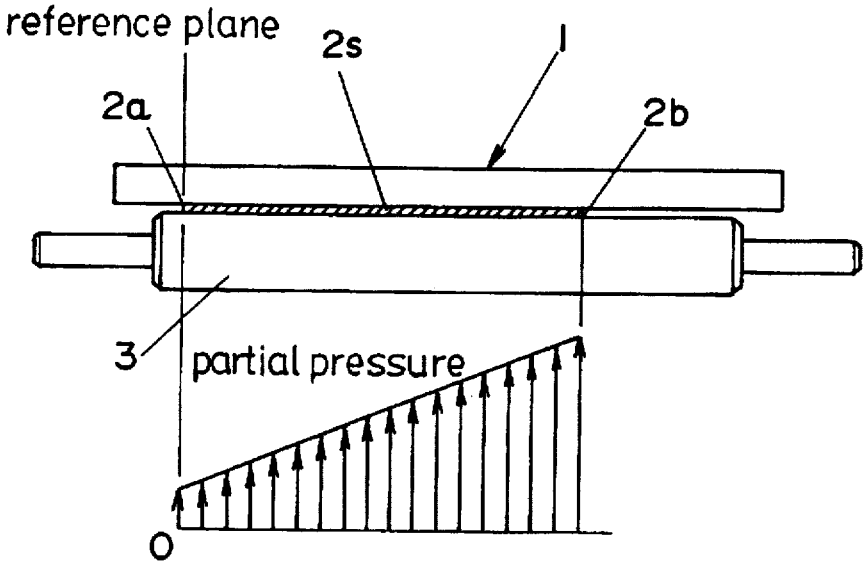
FIG. 13 PRIOR ART
FIG. 13 is a diagrammatic view of assistance in explaining a pressure distribution on a platen in a conventional thermal printer.
Figure 14:
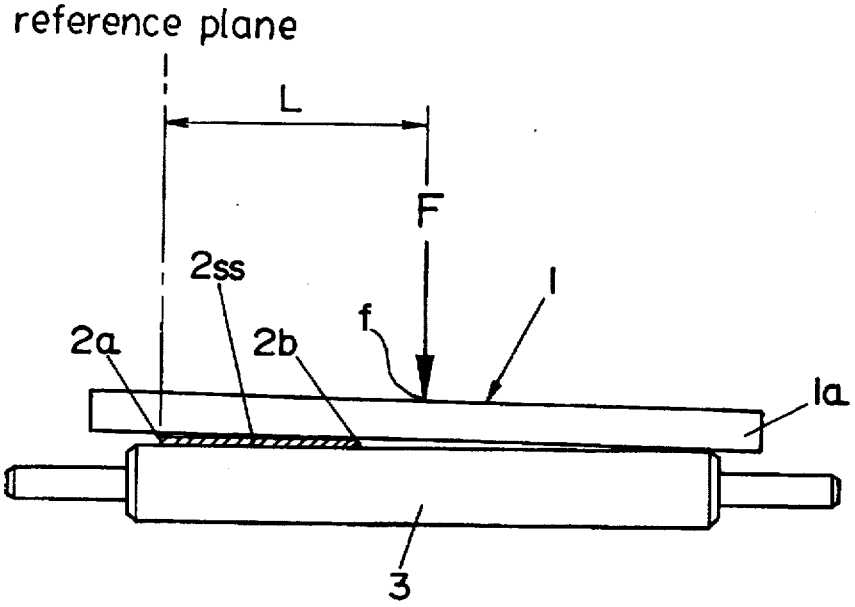
FIG. 14 PRIOR ART
FIG. 14 is a diagrammatic view of assistance in explaining tilt of a thermal print head relative to a platen in a conventional thermal printer when a recording sheet of a comparatively small width is used.

Seventh Embodiment (FIGS. 12A, 12B)

A thermal printer in a seventh embodiment according to the present invention will be described with reference to FIGS. 12A and 12B, in which parts like or corresponding to those shown in FIGS. 1A and 1B are designated by the same reference characters. The thermal printer in the seventh embodiment is substantially similar in construction to the thermal printer in the first embodiment shown in FIGS. 1A and 1B.

Referring to FIGS. 12A and 12B, the thermal printer is provided with an approach limiting mechanism comprising an eccentric stopping member 17 and a retaining member 18. The eccentric stopping member 17 is put on bearings 14 mounted on the shaft 3*a* of a platen 3 so as to be rotatable relative to the shaft 3*a* of the platen 3. The eccentric stopping member 17 has an eccentric cam portion 17*a* for determining the limit position of the free end 1*a* of a thermal print head 1, a grooved portion 17*b* provided with axial grooves 17*d*, and a grip portion 17*c* having a knurled circumference to ensure a firm grip. The retaining member 18 is formed by bending a plate spring and has a hook portion 18*a*. The retaining member 18 is fastened to the side wall of a main frame 6 so that the hook portion 18*a* thereof engages one of the grooves 17*d* of the grooved portion 17*b* to restrain the eccentric stopping member 17 from turning together with the platen 3.

The eccentric stopping member 17 is gripped at the grip portion 17*c* and turned to adjust the angular position of the eccentric cam portion 17*a* so that a desired minimum distance Ls between the thermal print head 1 and the platen is determined. The retaining member 18 retains the eccentric stopping member 17 with the eccentric cam portion 17*a* set at a desired angular position so that the eccentric stopping member 17 may not rotate together with the platen 3. The eccentric stopping member 17 may be formed so as to engage with a print head holding member 5 holding the thermal print head 1.

The thermal printer thus constructed in accordance with the present invention exerts the following effects.

In the thermal printer of the side-to-side alignment system constructed so that the pressure of the thermal print head may be distributed uniformly along a direction parallel to the axis of the platen, i.e., along a direction perpendicular to the sheet feed direction, when a recording sheet of a standard width is set thereon in a side-to-side alignment, the approach limiting means limits the approach of the free end of the thermal print head to the platen. Therefore, the pressure of the thermal print head can be uniformly distributed over the entire width of the recording sheet and the bias of the pressure distribution is reduced even if a recording sheet of a width smaller than the standard width is used and, consequently, characters and the like can be clearly printed on the recording sheet over the entire width of the recording sheet regardless of the width of the recording sheet.

The approach limiting means for limiting the approach of the thermal print head to the platen may be such as comprising the eccentric disk that stops the print head holding member holding the thermal print head, such as comprising the axially movable position adjusting member or such as comprising the turnable position adjusting member to adjust the minimum distance between the thermal print head and the platen with respect to the direction of action of the pressure of the thermal print head on the platen according to the width of the recording sheet.

Thus, the thermal printer in accordance with the present invention reduces the bias of the distribution of the pressure of the thermal print head on the recording sheet to print characters and the like in a satisfactory print quality, has a simple construction and can be formed in a compact light-weight construction.

Since the approach limiting means enables the determination of the minimum distance between the thermal print head and the platen properly according to the thickness of the recording sheet, characters and the like can be clearly printed in a satisfactory print quality regardless of the thickness of the recording sheet.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A thermal printer comprising:

a platen, a thermal print head which presses a thermal transfer ribbon and a recording sheet against the platen and which generates heat to record characters on the recording sheet, and approach limiting means for limiting a approach of the thermal print head to the platen, for imposing a minimum distance between the thermal print head and the platen and for counteracting a first moment applied to the thermal print head by the recording sheet.

2. A thermal printer according to claim 1, wherein said approach limiting means includes a stopping member disposed so as to stop the thermal print head, movable toward the platen, to determine directly a minimum distance between the thermal print head and the platen with respect to the direction of action of the pressure of the thermal print head.

3. A thermal printer according to claim 2, wherein the approach limiting means further includes a position adjusting member for adjusting the position of the stopping member to adjust the minimum distance between the thermal print head and the platen.

4. A thermal printer according to claim 1, wherein said approach limiting means includes a stopping member movable in a direction parallel to the axis of the platen, disposed so as to stop the thermal print head, movable toward the platen, to determine directly a minimum distance between the thermal print head and the platen with respect to the direction of action of the pressure of the thermal print head.

5. A thermal printer according to claim 4, wherein said approach limiting means further includes a position adjusting member for adjusting the axial position of the axially movable stopping member to adjust the minimum distance between the thermal print head and the platen.

6. A thermal printer according to claim 1, wherein said approach limiting means includes a turnable eccentric stopping member movable about the axis of the platen, disposed so as to stop the thermal print head, movable toward the platen, to determine directly a minimum distance between the thermal print head and the platen with respect to the direction of action of the pressure of the thermal print head.

7. A thermal printer according to claim 6, wherein said approach limiting means further includes a position adjusting member for adjusting the angular position of the turnable eccentric stopping member to adjust the minimum distance between the thermal print head and the platen.

8. A thermal printer according to claim 1, further comprising:

a print head holding member, attached to said thermal print head for holding said thermal print head, wherein said approach limiting means includes a stopping member disposed so as to stop the print head holding member to determine indirectly a minimum distance between the thermal print head and the platen with respect to the direction of action of the pressure of the thermal print head.

9. A thermal printer according to claim 8, wherein the approach limiting means further includes a position adjusting member for adjusting the position of the stopping member to adjust the minimum distance between the thermal print head and the platen.

10. A thermal printer according to claim 1, further comprising:

a print head holding member, attached to said thermal print head for holding said thermal print head, wherein said approach limiting means includes a stopping member, movable in a direction parallel to the axis of the platen, disposed so as to stop the print head holding member to determine indirectly a minimum distance between the thermal print head and the platen with respect to the direction of action of the pressure of the thermal print head.

11. A thermal printer according to claim 10, wherein said approach limiting means further includes a position adjusting member for adjusting the axial position of the axially movable stopping member to adjust the minimum distance between the thermal print head and the platen.

12. A thermal printer according to claim 1, further comprising:

a print head holding member, attached to said thermal print head for holding said thermal print head, wherein said approach limiting means includes a turnable eccentric stopping member, movable about the axis of the platen, disposed so as to stop the print head holding member, to determine indirectly a minimum distance between the thermal print head and the platen with respect to the direction of action of the pressure of the thermal print head.

13. A thermal printer according to claim 12, wherein said approach limiting means further includes a position adjusting member for adjusting the angular position of the turnable eccentric stopping member to adjust the minimum distance between the thermal print head and the platen.

14. A thermal printer according to claim 1, wherein said approach limiting means is located only to one side of the platen.

15. A thermal printer according to claim 1, wherein said approach limiting means consists essentially of a stopping member, located to one side of the platen, and means for adjusting the position of the stopping member.

16. A thermal printer according to claim 1, wherein said approach limiting means applies a force to a first half of the thermal print head in a first direction away from the platen, and wherein the only mechanical force in the first direction received by a second half of the thermal print head is through the recording sheet from the platen.

17. A thermal printer according to claim 1, further comprising:

a print head holding member, attached to said thermal print head for holding said thermal print head, wherein said approach limiting means applies a force to a first half of the print head holding member in a first direction away from the platen, and wherein the only mechanical force in the first direction received by a second half of the print head holding member is through the thermal print head and recording sheet from the platen.

18. A thermal printer comprising:

a platen, a thermal print head which presses a thermal recording sheet against the platen and which generates heat to record characters on the thermal recording sheet, and approach limiting means for limiting the approach of the thermal print head to the platen, for imposing a minimum distance between the thermal print head and the platen and for counteracting a first moment applied to the thermal print head by the thermal recording sheet.

19. A thermal printer according to claim 18, wherein said approach limiting means includes a stopping member disposed so as to stop the thermal print head, movable toward the platen, to determine directly a minimum distance between the thermal print head and the platen with respect to the direction of action of the pressure of the thermal print head.

20. A thermal printer according to claim 19, wherein said approach limiting means further includes a position adjusting member for adjusting the position of the stopping member to adjust the minimum distance between the thermal print head and the platen.

21. A thermal printer according to claim 18, wherein said approach limiting means includes a stopping member movable in a direction parallel to the axis of the platen, disposed so as to stop the thermal print head, movable toward the platen, to determine directly a minimum distance between the thermal print head and the platen with respect to the direction of action of the pressure of the thermal print head.

22. A thermal printer according to claim 21, wherein said approach limiting means further includes a position adjusting member for adjusting the axial position of the axially movable stopping member to adjust the minimum distance between the thermal print head and the platen.

23. A thermal printer according to claim 18, wherein said approach limiting means includes a turnable eccentric stopping member movable about the axis of the platen, disposed so as to stop the thermal print head, movable toward the platen, to determine directly a minimum distance between the thermal print head and the platen with respect to the direction of action of the pressure of the thermal print head.

24. A thermal printer according to claim 23, wherein said approach limiting means further includes a position adjusting member for adjusting the angular position of the turnable eccentric stopping member to adjust the minimum distance between the thermal print head and the platen.

25. A thermal printer according to claim 18, further comprising:

a print head holding member, attached to said thermal print head for holding said thermal print head, wherein said approach limiting means includes a stopping member disposed so as to stop the print head holding member to determine indirectly a minimum distance between the thermal print head and the platen with respect to the direction of action of the pressure of the thermal print head.

26. A thermal printer according to claim 25, wherein said approach limiting means further includes a position adjusting member for adjusting the position of the stopping member to adjust the minimum distance between the thermal print head and the platen.

27. A thermal printer according to claim 18, further comprising:

a print head holding member, attached to said thermal print head for holding said thermal print head, wherein said approach limiting means includes a stopping member, movable in a direction parallel to the axis of the platen, disposed so as to stop the print head holding member to determine indirectly a minimum distance between the thermal print head and the platen with respect to the direction of action of the pressure of the thermal print head.

28. A thermal printer according to claim 27, wherein said approach limiting means further includes a position adjusting member for adjusting the axial position of the axially movable stopping member to adjust the minimum distance between the thermal print head and the platen.

29. A thermal printer according to claim 18, further comprising:

a print head holding member, attached to said thermal print head for holding said thermal print head, wherein said approach limiting means includes a turnable eccentric stopping member, movable about the axis of the platen, disposed so as to stop the print head holding member, to determine indirectly a minimum distance between the thermal print head and the platen with respect to the direction of action of the pressure of the thermal print head.

30. A thermal printer according to claim 29, wherein said approach limiting means further includes a position adjusting member for adjusting the angular position of the turnable eccentric stopping member to adjust the minimum distance between the thermal print head and the platen.

31. A thermal printer according to claim 18, wherein said approach limiting means is located only to one side of the platen.

32. A thermal printer according to claim 18, wherein said approach limiting means consists essentially of a stopping member, located to one side of the platen, and means for adjusting the position of the stopping member.

33. A thermal printer according to claim 18, wherein said approach limiting means applies a force to a first half of the thermal print head in a first direction away from the platen, and wherein the only mechanical force in the first direction received by a second half of the thermal print head is through the recording sheet from the platen.

34. A thermal printer according to claim 18, further comprising:

a print head holding member, attached to said thermal print head for holding said thermal print head, wherein said approach limiting means applies a force to a first half of the print head holding member in a first direction away from the platen, and wherein the only mechanical force in the first direction received by a second half of the print head holding member is through the thermal print head and recording sheet from the platen.

* * * * *